US011883869B2

(12) United States Patent
Cunningham et al.

(10) Patent No.: US 11,883,869 B2
(45) Date of Patent: Jan. 30, 2024

(54) BUTT RETRIEVAL SYSTEM

(71) Applicant: Brilex Technical Solutions, LLC, Youngstown, OH (US)

(72) Inventors: James Allen Cunningham, Youngstown, OH (US); Kenneth James Platt, Youngstown, OH (US); Joseph Vasalani, Youngstown, OH (US)

(73) Assignee: Brilex Technical Solutions, LLC, Youngstown, OH (US)

( * ) Notice: Subject to any disclaimer, the term of this patent is extended or adjusted under 35 U.S.C. 154(b) by 166 days.

(21) Appl. No.: 17/412,569

(22) Filed: Aug. 26, 2021

(65) Prior Publication Data

US 2023/0065058 A1 Mar. 2, 2023

(51) Int. Cl.
*B21C 35/04* (2006.01)
*B21C 23/21* (2006.01)

(52) U.S. Cl.
CPC ..... *B21C 35/04* (2013.01); *B21C 23/21* (2013.01)

(58) Field of Classification Search
CPC ..... B21C 35/00; B21C 35/02; B21C 35/04
USPC ..... 72/254, 255
See application file for complete search history.

(56) References Cited

U.S. PATENT DOCUMENTS

| | | | | |
|---|---|---|---|---|
| 3,462,991 | A * | 8/1969 | Akira | B21C 23/21 72/257 |
| 3,838,589 | A * | 10/1974 | Behrendt | B21C 35/04 72/422 |
| 4,475,372 | A * | 10/1984 | Ostlinning | B21C 35/04 72/263 |
| 4,484,466 | A * | 11/1984 | Groos | B21C 23/218 72/255 |
| 4,750,345 | A * | 6/1988 | Groos | B21C 33/00 72/263 |
| 4,825,677 | A * | 5/1989 | Bessey | B21C 33/00 72/422 |
| 7,448,245 | B2 * | 11/2008 | Muschalik | B21C 33/00 72/257 |
| 8,122,752 | B2 * | 2/2012 | Yamamoto | B21C 35/04 72/427 |
| 10,625,330 | B2 | 4/2020 | Traenklein et al. | |

FOREIGN PATENT DOCUMENTS

| | | |
|---|---|---|
| CN | 201446147 | 5/2010 |
| CN | 102423773 | 4/2012 |
| JP | 3248713 | 11/1991 |

* cited by examiner

*Primary Examiner* — Katrina M Stransky
*Assistant Examiner* — P Derek Pressley
(74) *Attorney, Agent, or Firm* — Lippes Mathias LLP

(57) ABSTRACT

A butt retrieval system having a butt retrieval receptacle supported outside the main footprint of an extrusion press such that maintenance and/or repair of the system is simplified. The butt retrieval system includes a butt retrieval receptacle moveable between a butt retrieving position and a butt unloading position. The butt retrieval receptable has a cantilevered arm extending from a base portion of the butt retrieval receptacle in a direction towards the centerline of the associated extrusion press.

10 Claims, 2 Drawing Sheets

BUTT RETRIEVAL SYSTEM

BACKGROUND

The present exemplary embodiment relates to an apparatus for retrieving waste from a metal forming machine. It finds particular application in conjunction with retrieving butts from an aluminum extrusion press, and will be described with particular reference thereto. However, it is to be appreciated that the present exemplary embodiment is also amenable to other like applications.

Aluminum extrusion is a process wherein hot aluminum is forced through a die to form a long, continuous shape, such as a tube, c-channel, I-beam, etc. This process is typically performed using a high tonnage press oriented horizontally. At one end of the press is a large hydraulic cylinder that generates the force required to push the aluminum through the die. A preheated cylinder of aluminum, called a billet, is inserted in front of the cylinder and then moved into a container. The container is then sealed against the die, which keeps the flow of aluminum going through the die instead of out in all directions when pushed on by the cylinder. At the other end of the press is a thick plate that reacts the force of the hydraulic cylinder. The die is held in front of this platen during the extrusion process. As the aluminum flows through the die, many impurities that were on the outside skin of the billet end up in the final few inches of aluminum. This impure aluminum is not pushed through the die to become product, but rather it is discarded as scrap. This discarded portion of billet is commonly referred to as a butt.

Typically, the butt is stuck to the outside face of the die and must be removed with a shear or saw operation. In a typical extrusion press the detached butt falls into a pit below the press where it must be gathered and transported to an area where it can be recycled. This is usually done by means of a conveyor system or elevator. The dropping of the butt onto the conveyor or elevator tends to be rough on that equipment.

Maintenance of the conveyor or elevator is made more difficult because it is typically situated in a pit under the press. Accordingly, any repairs or maintenance often require press operation to be shut down for long periods of time while proper precautions are taken due to the equipment being in a confined space which may be full of oil that has leaked from the press and is often crowded with butts that have missed or fell off the conveyor.

Other butt retrieval systems have utilized a hopper positioned below a press for collecting the butts. The hopper is supported on a track and movable from a position below the press to the position adjacent the press for unloading of the butts. Such systems, however, still require equipment to be installed in a pit under the press, and thus still suffer many of the same shortcomings of the conveyor systems described above.

BRIEF DESCRIPTION

The present disclosure sets forth a butt retrieval system that can be supported outside the main footprint of an extrusion press such that maintenance and/or repair of the system is simplified. The butt retrieval system of the present disclosure is also readily retrofittable to existing extrusion presses, and eliminates the need for a pit below an extrusion press.

In accordance with one aspect, a butt retrieval system for removing discarded portions of a billet from an associated extrusion press comprises a base mountable to a surface adjacent the associated extrusion press, a movable butt retrieval receptacle supported on the base for reciprocating motion in a direction towards and away from a centerline of the associated extrusion press, and a drive motor coupled to the movable butt retrieval receptacle for moving the butt retrieval receptacle between a butt retrieving position and a butt unloading position. The butt retrieval receptable has a cantilevered arm extending from a base portion of the butt retrieval receptacle in a direction towards the centerline of the associated extrusion press.

The cantilevered arm can extend beyond the base when the butt retrieval receptacle is in the butt retrieving position. The butt retrieval receptacle can include a bucket supported for pivoting movement relative to the cantilevered arm between a butt receiving position generally parallel to the cantilevered arm and a butt dumping position generally perpendicular to the cantilevered arm. The bucket can be configured to be in the butt receiving position when the butt retrieval receptacle is in the butt retrieving position and to be in the butt dumping position when the butt retrieving receptacle is in the butt unloading position. The butt retrieving receptacle can include a chute having a first end configured to receive a butt from the bucket when the bucket is in the butt dumping position and a second end from which the butt is unloaded from the butt retrieval receptacle. The butt retrieval receptacle can include an actuator for moving the bucket between the butt receiving position and the butt dumping position. The butt retrieval receptacle can be supported on low-friction slides. A hopper can be adapted to receive discarded butts.

In accordance with another aspect, a method of retrieving butts from an extrusion press using a butt retrieval system for removing discarded portions of a billet is set forth. The method comprises moving a butt retrieval receptacle of the system into a butt retrieval position, receiving a butt in the butt retrieval receptacle, moving the butt retrieval receptacle to a butt unloading position, and discarding the butt. The butt retrieval system for removing discarded portions of a billet from an associated extrusion press includes a base mountable to a surface adjacent the associated extrusion press, a movable butt retrieval receptacle supported on the base for reciprocating motion in a direction towards and away from a centerline of the extrusion press, and a drive motor coupled to the movable butt retrieval receptacle for moving the butt retrieval receptacle between the butt retrieving position and the butt unloading position. The butt retrieval receptable has a cantilevered arm extending from a base portion of the butt retrieval receptacle in a direction towards the centerline of the associated extrusion press.

DETAILED DESCRIPTION

Figure 1:
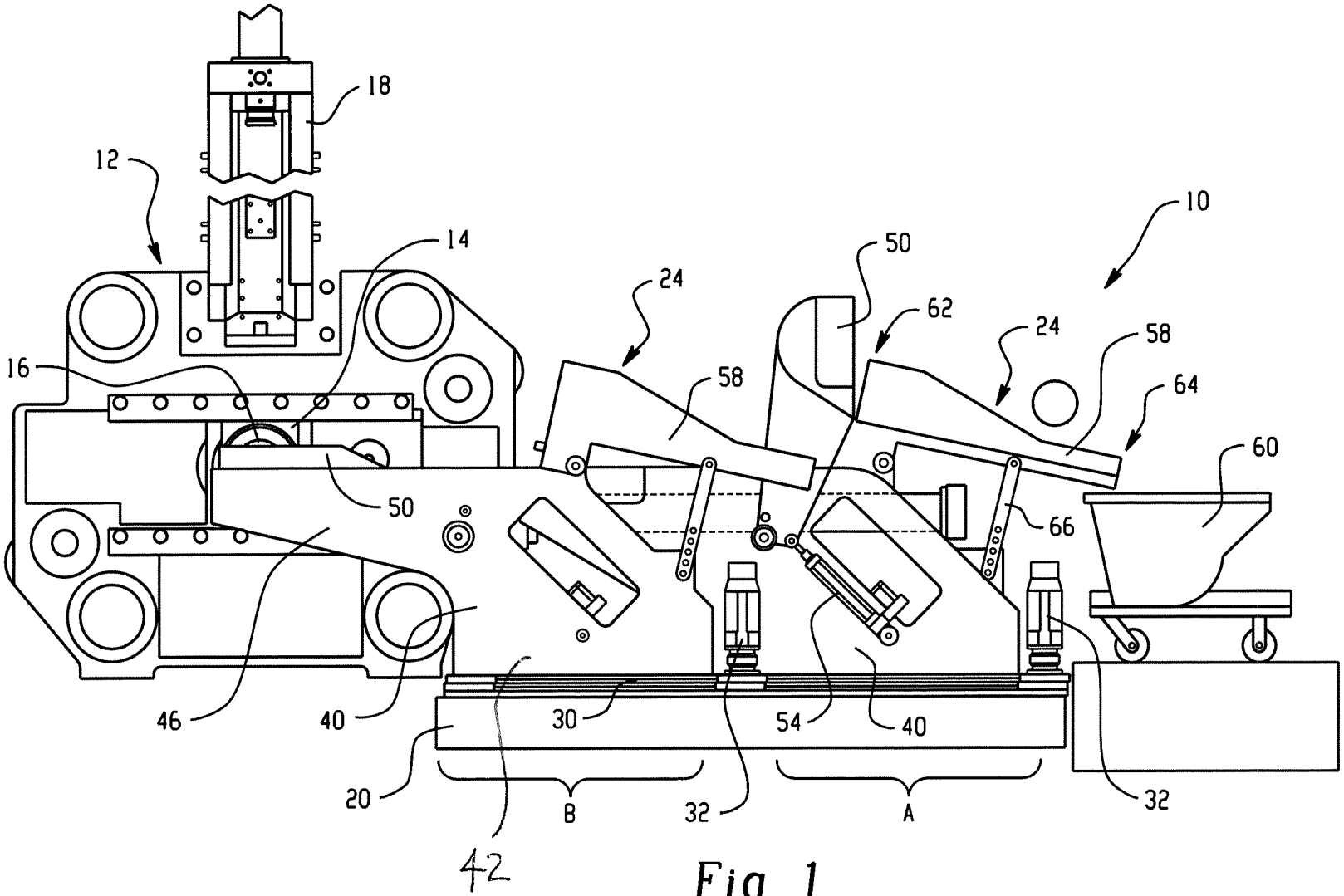
FIG. 1 is a front elevation view of an exemplary butt retrieval system in accordance with the present disclosure installed in a first orientation adjacent an extrusion press.

With reference to FIG. 1, an exemplary butt retrieval system is illustrated and identified generally by reference numeral 10. The butt retrieval system 10 is illustrated in connection with an extrusion press 12, but it should be appreciated that the butt retrieval system 10 can be used in connection with a variety of machinery in addition to an extrusion press. The extrusion press 12 can be any style of extrusion press and the details of the depicted extrusion press 12 are not generally germane to the present disclosure. For the purposes of the following discussion, it should be appreciated that the extrusion press includes a die 14 through which a billet is extruded and on which a butt 16 remains after extrusion of the billet. A butt shear 18 is mounted above the die 14 and configured to shear the butt off the die 14 in a conventional manner.

Figure 2:
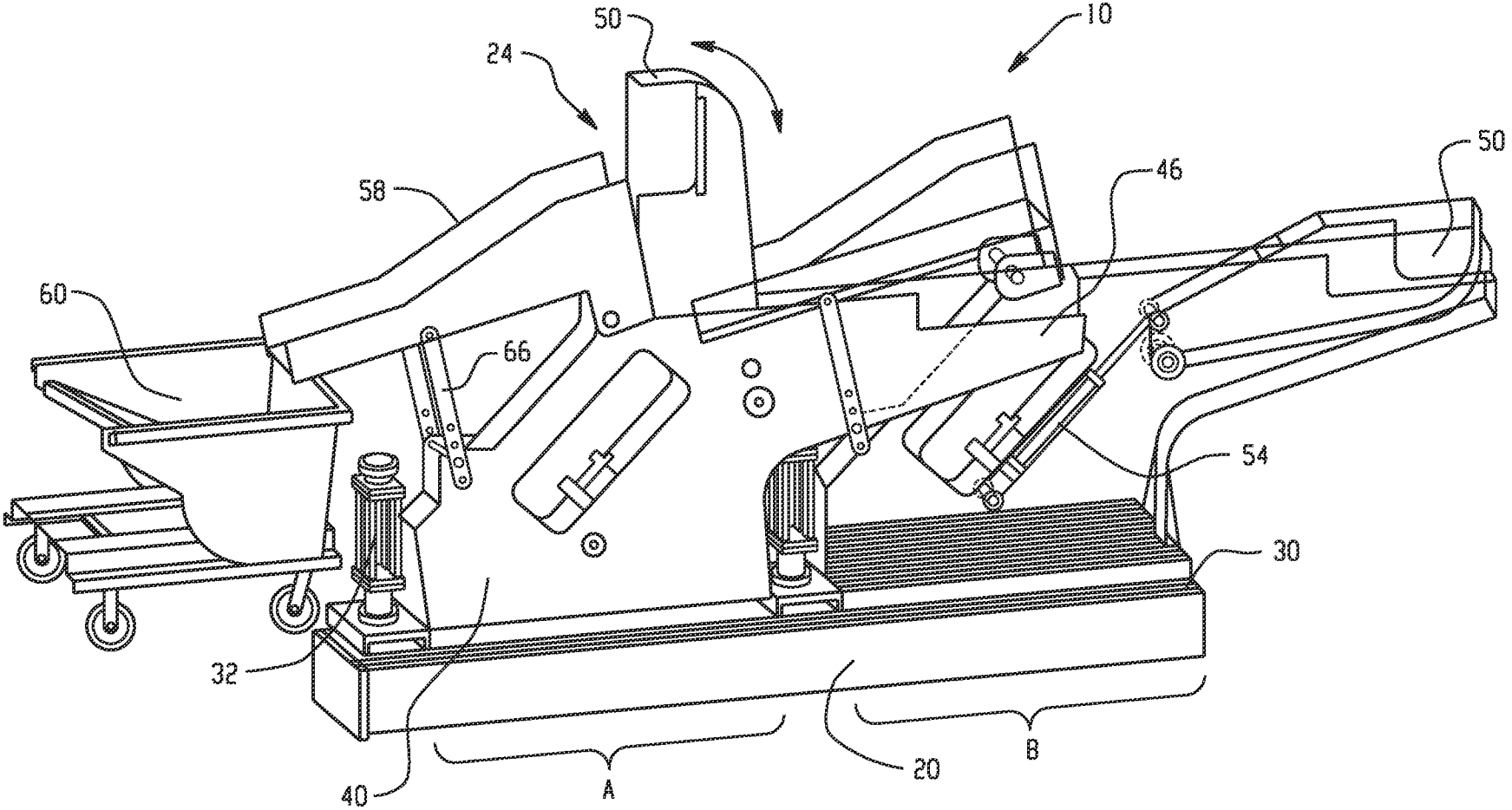
FIG. 2 is a front elevation view of the exemplary butt retrieval system in an alternative orientation.

With additional reference to FIG. 2, the butt retrieval system 10 of the present disclosure includes a base 20 and a retrieval arm (receptacle) 24 supported on the base 20 for reciprocating movement from a first (unloading) position A spaced from the extrusion press 12 and a second (receiving) position B wherein a portion of the retrieval arm 24 is located under the die 14 in position to receive the butt 16. In FIG. 1, the retrieval arm 24 is shown in both the receiving position B (on the left) and the unloading position A (on the right) on the base 20. In FIG. 2, the retrieval arm 24 is shown in both the receiving position B (on the right) and the unloading position A (on the left) on the base 20. It should be understood that the illustrated retrieval arm 24 moves between the two positions A and B shown in FIGS. 1 and 2, and that the base 20 can be oriented in any direction relative to the press 12 depending on a particular application.

The base 20 is mounted to a portion of the press bedplate or clamped or otherwise secured to a lower tie rod of the press and/or to an existing concrete foundation for the press. The base 20 includes low friction slides 30 upon which the retrieval arm 24 is supported. The low friction slides 30 can be linear guide rails with encapsulated bearing guides or linear slides, for example. A drive motor 32 is coupled to the retrieval arm 24 for precisely and quickly translating the retrieval arm 24 between the unloading and receiving positions A and B.

In a typical installation, such as the illustrated embodiment of FIG. 1, the base 20 is aligned perpendicular to the centerline of the press (line of action for extrusion, perpendicular to and extending out of the page). In other installations, the base 20 can be aligned at an angle other than perpendicular to the centerline of the press, though in such installations the arrangement of the retrieval arm 24 will be modified such that it is perpendicular to the centerline of the press 12 when in the receiving position. The slides 30 of the base 20 allow for accurate movement of the retrieval arm 24 into (towards) and out of (away) from the centerline of the press 12.

The retrieval arm 24 generally includes a main body 40 having a base portion 42 supported on the slides 30 and a cantilevered arm 46 extending laterally beyond the base portion 42 towards the centerline of the press 12. The arm 46 supports a bucket 50 that is configured to receive a sheared-off butt 16. The bucket 50 is supported for pivoting motion between a first (butt receiving) position when the retrieval arm 24 is in the receiving position B, and a second (butt dumping) position shown when the retrieval arm 24 is in the unloading position A. A dump actuator 54 is coupled to the bucket 50 and configured to move the bucket 50 between the butt receiving and butt dumping positions. The main body 40 also supports an adjustable chute 58 that directs the butt to a hopper 60. The chute has a first end 62 for receiving the butt from the bucket 50, and a second end 64 from which the butt is transfer from the chute 58 to the hopper 60. An adjustable support arm 66 allows height of the second end 64 of the chute 58 to be adjusted to closer match a range of hopper sizes.

During operation, after the press 12 has performed an extrusion operation, the drive motor 32 is activated to translate the retrieval arm 24 into the press 12 to the receiving position thereby aligning the bucket 50 with the centerline of the press 12 in position to receive the butt 16. The butt 16 is then sheared off the die 14 by the butt shear 18. The butt 16 is received in the bucket 50, and drive motor 32 is activated to quickly retract the retrieval arm 24 out of the press 12 to the unloading position. Once the retrieval arm 24 is in the unloading position, the dump actuator 54 is activated to pivot the bucket 50 to the dump position at which time the butt 16 is transferred to the chute 58. The slope of the chute 58 results in the butt 16 travelling down the chute 58 to the hopper 60. It should be appreciated that the chute 58 has a general downward slope to allow the butt to slide, tumble or roll under the influence of gravity down the chute to the hopper 60. The dump actuator 54 then returns the bucket 50 to the receiving position and the butt retrieval system 10 is ready for another cycle.

In some embodiments, the retrieval arm 24, after dumping a butt 16, may return to a starting position located intermediate the receiving position and the unloading position. This can shorten the distance the retrieval arm 24 must travel into the press 12 on initiation of a cycle thereby decreasing the amount of time the butt retrieval system 10 required to remove a butt.

It should be appreciated that the bucket 50 is positioned closely to the butt such that the butt travels downwardly only a small distance compared to prior art butt retrieval systems. This minimizes the impact of the butt on the butt retrieval system when the butt is sheared from the die. When the butt is transferred to the hopper 60, a relatively larger impact may result to the hopper. Compared to prior art systems, however, this larger impact to the hopper is not to equipment mounted in pit below the press that is difficult to service. Instead, servicing or replacing the hopper due to wear from the butt impacts can be done without shutting down the press.

Cycle time of the butt retrieval system is based on the operation of the press and available time allotted for retrieving the butt. The cycle time in and out of the press can be 5 seconds or less, but this is determined at least in part on the time it takes to shear the butt from the die face. In one embodiment, the system is designed for 1.5 seconds into the press to receive the butt, and approximately 1 second to remove the retriever from the press.

The drive motor can be a standard servo-drive motor and can be supplied in various configurations to accommodate various speed requirements. Drive motor size and specifications are also based on available supply voltage. Lower voltage (230V) would require a larger drive than a higher voltage (400/480V.) An example drive motor is a Bosch Rexroth MS2N10 mounted on a gearbox. The actuator for the dump mechanism generally would include an electric actuated linear servo drive, but other actuators could be used.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A butt retrieval system for removing discarded portions of a billet from an associated extrusion press comprising:

a base mountable to a surface adjacent the associated extrusion press;

a movable butt retrieval receptacle supported on the base for reciprocating motion in a direction towards and away from a centerline of the associated extrusion press; and a drive motor coupled to the movable butt retrieval receptacle for moving the butt retrieval receptacle between a butt retrieving position and a butt unloading position;

wherein the butt retrieval receptacle has a cantilevered arm extending from a base portion of the butt retrieval receptacle in a direction towards the centerline of the associated extrusion press;

wherein the cantilevered arm extends beyond the base when the butt retrieval receptacle is in the butt retrieving position;

wherein the butt retrieval receptacle includes a bucket supported for pivoting movement relative to the cantilevered arm between a butt receiving position generally parallel to the cantilevered arm and configured to receive a butt from above and a butt dumping position generally perpendicular to the cantilevered arm;

wherein the bucket is configured to be in the butt receiving position when the butt retrieval receptacle is in the butt retrieving position and to be in the butt dumping position when the butt retrieving receptacle is in the butt unloading position;

wherein the butt retrieving receptacle includes a chute having a first end configured to receive a butt from the bucket when the bucket is in the butt dumping position and a second end from which the butt is unloaded from the butt retrieval receptacle.

2. The butt retrieval system of claim 1, wherein a slope of the chute is adjustable.

3. The butt retrieval system of claim 1, wherein the butt retrieval receptacle includes an actuator for moving the bucket between the butt receiving position and the butt dumping position.

4. The butt retrieval system of claim 1, wherein the butt retrieval receptacle is supported on low-friction slides.

5. The butt retrieval system of claim 1, further comprising a hopper for receiving a butt from the butt retrieval receptacle.

6. A method of retrieving butts from an extrusion press using a butt retrieval system for removing discarded portions of a billet, the method comprising:

moving a butt retrieval receptacle of the system into a butt retrieval position receiving a butt in the butt retrieval receptacle;

moving the butt retrieval receptacle to a butt unloading position; and discarding the butt;

wherein the butt retrieval system for removing discarded portions of a billet from an associated extrusion press includes:

a base mountable to a surface adjacent the associated extrusion press;

a movable butt retrieval receptacle supported on the base for reciprocating motion in a direction towards and away from a centerline of the extrusion press; and a drive motor coupled to the movable butt retrieval receptacle for moving the butt retrieval receptacle between the butt retrieving position and the butt unloading position; and wherein the butt retrieval receptacle has a cantilevered arm extending from a base portion of the butt retrieval receptacle in a direction towards the centerline of the associated extrusion press;

wherein the cantilevered arm extends beyond the base when the butt retrieval receptacle is in the butt retrieving position;

wherein the butt retrieval receptacle includes a bucket supported for pivoting movement relative to the cantilevered arm between a butt receiving position generally parallel to the cantilevered arm and configured to receive a butt from above and a butt dumping position generally perpendicular to the cantilevered arm;

wherein the bucket is configured to be in the butt receiving position when the butt retrieval receptacle is in the butt retrieving position and to be in the butt dumping position when the butt retrieving receptacle is in the butt unloading position;

wherein the butt retrieving receptacle includes a chute having a first end configured to receive a butt from the bucket when the bucket is in the butt dumping position and a second end from which the butt is unloaded from the butt retrieval receptacle.

7. The method of claim 6, wherein a slope of the chute is adjustable.

8. The method of claim 6, wherein the butt retrieval receptacle includes an actuator for moving the bucket between the butt receiving position and the butt dumping position.

9. The method of claim 6, wherein the butt retrieval receptacle is supported on low-friction slides.

10. The method of claim 6, wherein the butt retrieval system further includes a hopper for receiving a butt from the butt retrieval receptacle.

* * * * *